US005928033A

United States Patent [19]

Kato et al.

[11] Patent Number: 5,928,033

[45] Date of Patent: Jul. 27, 1999

[54] WATERPROOF STRUCTURE FOR CONDUCTOR LEADING PART

[75] Inventors: Tetsuo Kato; Akira Shinchi; Nobuyuki Asakura, all of Shizuoka-ken, Japan

[73] Assignee: Yazaki Corporation, Tokyo, Japan

[21] Appl. No.: 08/990,325

[22] Filed: Dec. 17, 1997

[30] Foreign Application Priority Data

Dec. 26, 1996 [JP] Japan ..... P 8-348057
May 22, 1997 [JP] Japan ..... P 9-132515

[51] Int. Cl.[6] ..... H01R 13/40

[52] U.S. Cl. ..... 439/587; 29/878; 174/77 R

[58] Field of Search ..... 439/587, 589, 439/936, 204; 29/874, 876, 878; 174/74 R, 77 R

[56] References Cited

U.S. PATENT DOCUMENTS 3,777,048 12/1973 Traut ..... 174/73.1
3,879,239 4/1975 Rager et al. ..... 156/73.1
5,372,665 12/1994 Chafin et al. ..... 156/73.1

FOREIGN PATENT DOCUMENTS 50-54591 5/1975 Japan .

*Primary Examiner*—Neil Abrams
*Assistant Examiner*—T C Patel
*Attorney, Agent, or Firm*—Finnegan, Henderson, Farabow, Garrett & Dunner, L.L.P.

[57] ABSTRACT

A waterproof structure for a wire leading part of a housing is provided. The structure includes two cover bodies and two waterproof members carried by the cover bodies. The waterproof members are made of elastic materials which are soluble in each other and fusible in insulating covers of wires by ultrasonic oscillation under pressure. At the mutual welding of the cover bodies by the ultrasonic oscillation, the waterproof members are fused in each other, the waterproof members are fused in the insulating covers and the cover bodies are welded to the housing.

2 Claims, 8 Drawing Sheets

WATERPROOF STRUCTURE FOR CONDUCTOR LEADING PART

BACKGROUND OF THE INVENTION

The present invention relates to a waterproof structure for a conductor leading part of a connector. In detail, it relates to a waterproof structure which is capable of covering and waterproofing a wire leading part in a wiring instrument (e.g. a waterproof connector, an electrical connection box etc.) with at least one waterproof member.

For example, Japanese Unexamined Utility Model Publication (Kokai) No. 50-54591 discloses a conventional art waterproof structure where a plurality of covered wires are interposed between an upper half rubber plug and a lower half rubber plug, so that the resulting plug assembly is press-fitted into a recess formed on a connector housing.

In the above-mentioned conventional waterproof structure, however, there are problems to be solved despite that the plural wires can be waterproofed collectively. That is, it is troublesome for a worker to fit the rubber plug assembly into the connector housing and the manufacturing cost is increased due to the necessity of establishing different molding dies for the upper and lower rubber plugs in accordance with the size of wires and the number of poles.

Moreover, in the manufacturing process of the conventional waterproof structure, it is difficult to put two rubber plugs together without producing any clearance. Therefore, the waterproof function of the structure is easy to be deteriorated at a joint of the upper and lower rubber plugs, disadvantageously.

SUMMARY OF THE INVENTION

It is therefore an object of the present invention to provide a waterproof structure for a wire leading part, which exhibits high waterproof capability in spite of low manufacturing cost and which is applicable for various kinds and sizes of wires.

The object of the present invention described above can be accomplished by a waterproof structure for a conductor leading part of a housing, through which a plurality of conductors covered with resinous insulating covers are drawn out from the housing, the waterproof structure comprising:

one or more waterproof members arranged about the conductors at the conductor leading part, the waterproof members being soluble in each other and fusible in the resinous insulating covers.

In this waterproof structure for the conductor leading part, under condition that the conductors are drawn out from the housing, the conductor leading part is fused in the one or more waterproof members, while the waterproof members are melted with the insulating covers for integration.

In the present invention, preferably, the conductors are a plurality of electrical wires which are drawn out from the conductor leading part so as to be in parallel with each other.

More preferably, the housing is composed of two housing elements obtained by bisecting the housing along a direction to arrange the electrical wires in parallel, while the waterproof members are respectively arranged in half wire leading parts obtained by bisecting the conductor leading part.

In this case, under their mutually butting condition of the housing elements and the half wire leading parts, the electrical wires are interposed between the waterproof members. Accordingly, by heating the wire leading part by, for example, ultrasonic oscillation while keeping the above-mentioned interposed condition, the waterproof members are mutually melted and fused in the insulating covers of the wires for integration.

Alternatively, upon melting material constituting the waterproof members at temperature more than a melting point of the insulating covers of the electrical wires, the resulting molten material may be charged around the electrical wires at the wire leading part, providing the waterproof members. In this case, the insulating covers are melted with the waterproof members into one body.

According to the present invention, the object of the invention can be also accomplished by a waterproof structure for a wire leading part of a housing, through which a plurality of electrical wires covered with insulating covers are drawn out, the waterproof structure comprising:

two waterproof members for interposing the electrical wires therebetween at the wire leading part, the waterproof members being made of elastic materials which are soluble in each other and soluble in the insulating covers by ultrasonic oscillation under pressure; and two cover bodies for supporting the waterproof members respectively, the cover bodies being made of materials which are fusible in each other and soluble in the housing by ultrasonic oscillation under pressure.

With the above-mentioned arrangement, it is possible to carry out the mutual fusing between the waterproof members, the fusing between the waterproof members and the insulating covers of the wires, and the welding of the cover bodies to the housing, at the same time of mutually fusing of the cover bodies by the ultrasonic oscillation. Consequently, with above-mentioned fusing and welding, the housing, the cover bodies, the waterproof members and the wires are constituted as if they were an integrated component.

In the above-mentioned waterproof structure, preferably, one of the cover bodies is formed integrally with the housing, while the other of the cover bodies is rotatably connected with the housing through a hinge.

In this case, it is possible to reduce the number of components forming the waterproof structure.

In addition, according to the invention, there is also provided a waterproof structure for a connector, comprising:

a housing; and a wire leading part which is formed integrally with the housing and through which a plurality of electrical wires covered with insulating covers are drawn out, the wire leading part being made of material which is soluble in the insulating covers by ultrasonic oscillation.

In this waterproof structure, under condition that the electrical wires are drawn out of the housing, the wire leading part is compressed and heated by the ultrasonic oscillation. Thus, the wire leading part and the insulating covers of the wires are fused and integrated.

According to the invention, there is also provided a method of producing a waterproof structure for a wire leading part of a housing, the method comprising the steps of:

partially drawing at least one electrical wire, which is covered with an insulating cover, out of the housing through the wire leading part;

interposing the electrical wire between two waterproof members at the wire leading part in a manner that the waterproof members butt against each other, the waterproof members being carried by cover bodies; and oscillating the waterproof members by ultrasonic waves through the cover bodies, thereby fusing the waterproof members in each other, fusing the waterproof members in the insulating cover, and fusing the cover bodies in the housing, integrally.

These and other objects and features of the present invention will become more fully apparent from the following description and appended claims taken in conjunction with the accompany drawing.

DESCRIPTION OF THE PREFERRED EMBODIMENT

Various embodiments of the present invention will be described with reference to the drawings.

the first embodiment

Figure 1:
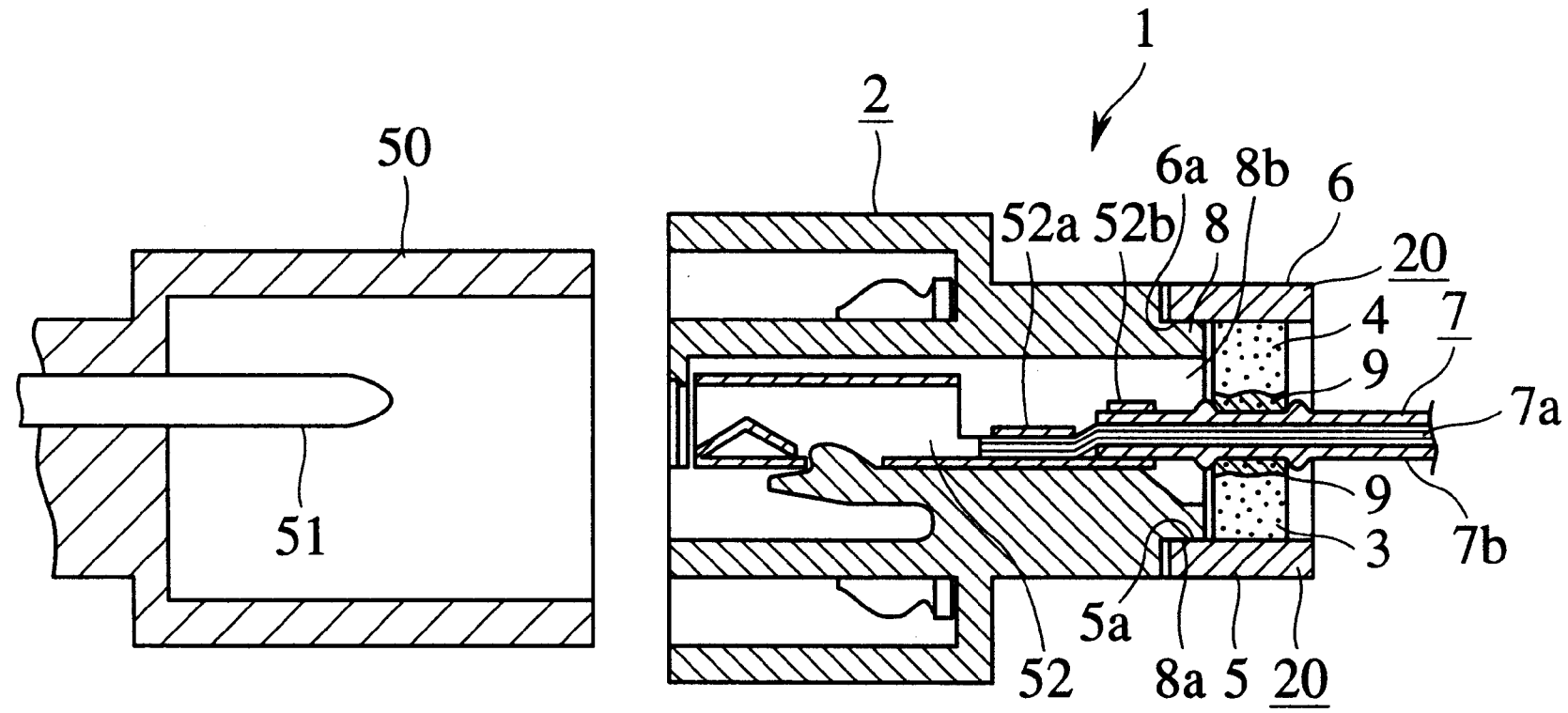
FIG. 1 is a longitudinal cross sectional view of a connector equipped with a waterproof structure of a wire leading part in accordance with a first embodiment of the present invention, taken along a line I—I of FIG. 2.
Figure 2:
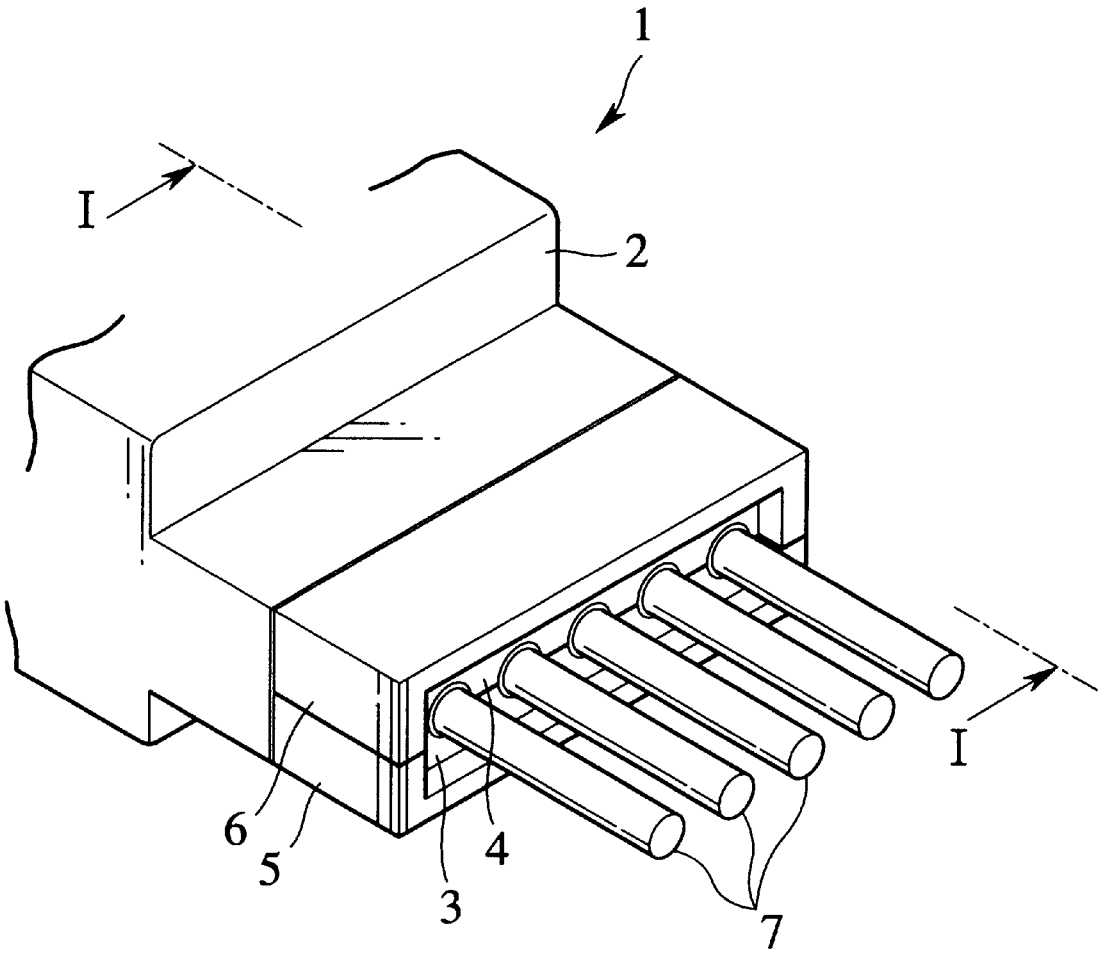
FIG. 2 is a perspective view of the connector of FIG. 1, in accordance with the first embodiment of the invention.
Figure 3:
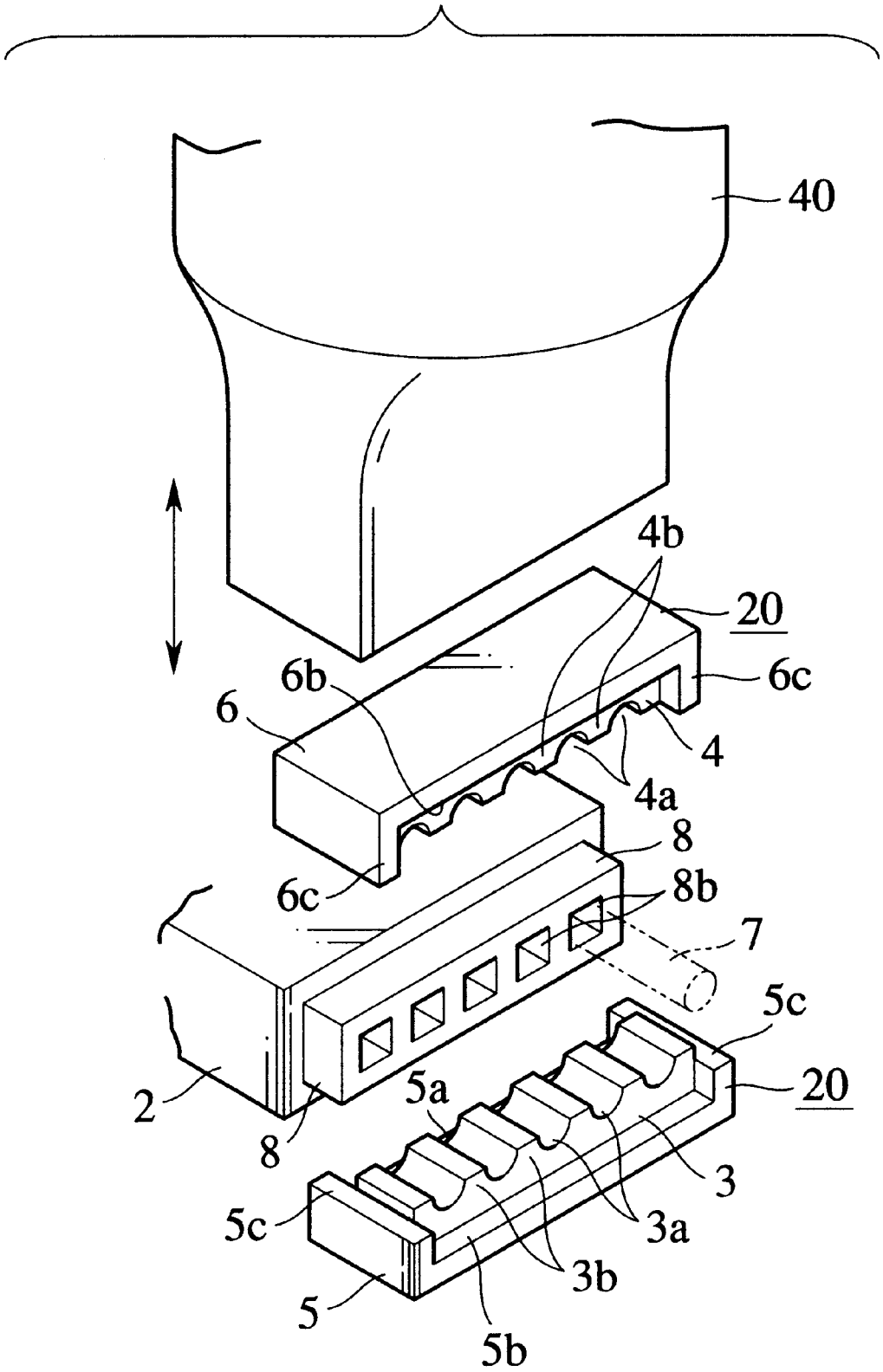
FIG. 3 is an exploded perspective view showing a manufacturing process of the connector of FIG. 1.

FIGS. 1 to 3 show a waterproof structure of a wire leading part, in accordance with the first embodiment of the present invention, also showing n example of the structure applied to a wire leading part of a connector.

In the connector 1, covered wires 7 drawn out from a housing 2 is covered with two division waterproof members 3, 4 interposing the wires 7 therebetween, while the waterproof members 3, 4 covering the wires 7 are supported by two divisional cover bodies 5, 6 formed in integral with the housing 2, thereby providing the waterproof structure of the embodiment.

As shown in FIG. 3, the housing 2 is provided, on an end face thereof, with a leading part 8 projecting forward in form of a small square pillar. In the leading part 8, a plurality of leading holes 8*b* are formed to open at the front end face of the part 8 and communicate with an interior of the housing 2. The covered wires 7 are partially drawn out of the housing 2 through the leading holes 8*b,* respectively.

The waterproof members 3, 4 are made of resilient materials which are soluble in each other by ultrasonic oscillation under pressure and which exhibit mutual solubility against insulating covers 7*b* of the wires 7. The waterproof members 3, 4 are provided, on mutual opposite surfaces thereof, with accommodating grooves 3*a,* 4*a* divided by ribs 3*b,* 4*b,* as shown in FIG. 3. Note, these accommodating grooves 3*a,* 4*a* are formed corresponding to the leading holes 8*b,* respectively.

Preferably recommended for materials of the above-mentioned cover bodies 5, 6 are acrylic resin, ABS (acrylonitrile-butadiene-styrene) resin, PC (polycarbonate) resin, PVC (poly vinyl chloride) resin, PE (polyethylene) resin, PEI (polyether imide) resin, PBT (polyethylene terephthalate) resin or the like, which are hard in comparison with vinyl chloride etc. utilized for the insulating covers 7*b*. As to aptitude of the cover bodies 5, 6 in case of adopting the above-mentioned resins, all of the resins are appreciated to be of practical use in terms of conductivity and conductive stability. Further, in case of estimating the resins including their exterior appearance and electric insulation, PEI (polyether imide) resin and PBT (polyethylene terephthalate) are suitable particularly.

In case of adopting polyesther elastomer as the resilient member, PBT would be the best material as resin for the cover bodies 5, 6. In such a case, it would be easy to accomplish the mutual solution since the chemical structure of polyesther elastomer exhibits a block copolymer consisting of PBT and polyesther.

While, as the resilient member, it is preferable to select resinous material which has the mutual solubility against the material of the insulating covers 7*b;* elastomer material, such as synthetic rubber or synthetic plastics, that is, material which can be stretched twice as long as the original length with low stress at room temperature and which can return to the original length once the stress is released. Preferably recommended for the resin having the mutual solubility in the insulating covers 7*b* are (1) alloy of ABS (acrylonitrile-butadiene-styrene) and vinyl chloride, (2) alloy of acrylonitrile and vinyl chloride, (3) polyesther elastomer or the like. Among these materials, polyesther elastomer etc. (e.g. block copolymer consisting of polybutylene terephthalate and polyether) is more preferably.

Note, generally, the above term "mutual solubility" represents the degree of familiarity between two materials and in this specification, it especially relates to a characteristic that a plastic material gets mixed with a high polymer and is expressed by a quantitative limit of the plastic material where no phase separation is caused in case of charging the plastic material in the high polymer.

Being provided with accommodating parts 5*b,* 6*b,* respectively, the cover bodies 5, 6 are formed to have substantial U-shaped configurations, as shown in FIG. 3. The waterproof members 3, 4 are accommodated in the accommodating parts 5*b,* 6*b,* respectively, thereby constituting waterproof components 20. Although each of the waterproof components 20 may be constituted by combining the cover body 5 (6) and the waterproof member 3 (4) with each other, both of which are formed individually, in detail, by manually fitting the waterproof member 3 (4) in the cover body 5 (6), it is preferable to mold the cover body 5 (6) and the waterproof member 3(4) in one body.

Owing to the integration of the cover body 5 (6) and the waterproof member 3 (4), it is possible to ensure the liquid-tightness of engagement portions between the waterproof member 3(4) and the cover body 5 (6).

According to the embodiment, the waterproof members 3, 4 are formed in a manner that, when respectively assembling in the cover bodies 5, 6, respective tips of the ribs 3*b*, 4*b* project from the cover bodies 5, 6 outward. With this formation, during generating ultrasonic waves, the waterproof members 3, 4 can be strongly pressed on with other, thereby to promote the mutual melting and their melting with the insulating covers 7*b* of the covered wires 7.

With the above-mentioned arrangement, the waterproof structure of the wire leading part can be realized as follows.

First of all, female terminals 52 connected with the covered wires 7 are engaged in the connector housing 2 and thereafter, the wires 7 are partially drawn out of the housing 2 through the leading holes 8*b*. Being provided with core lines 7*a* and the covering part 7*b* crimped by crimp pieces 52*a*, 52*b* respectively, the covered wires 7 are connected with the female terminal 52 (see FIG. 1). Note, in FIG. 1, reference numeral 50 designates a mating connector to be connected with the connector 1, and 51 denotes a male terminal which is inserted into the female terminal 52 in the connector 1 when it is connected with the connector 50.

Next, the covered wires 7 are fitted into the accommodating grooves 3*a*, 4*a* of the waterproof members 3, 4 and thereafter, the waterproof components 20, 20 are confronted with each other while butting the ribs 3*b* against the ribs 4*b*, respectively. With this butting, respective ribs 5*c* on both sides of the cover body 5 are opposed to ribs 6*c* on both sides of the cover body 6 and similarly, respective inner faces 5*a*, 6*a* of the bodies 5, 6 are opposed against an outer face 8*a* of the leading part 8.

Figure 4:
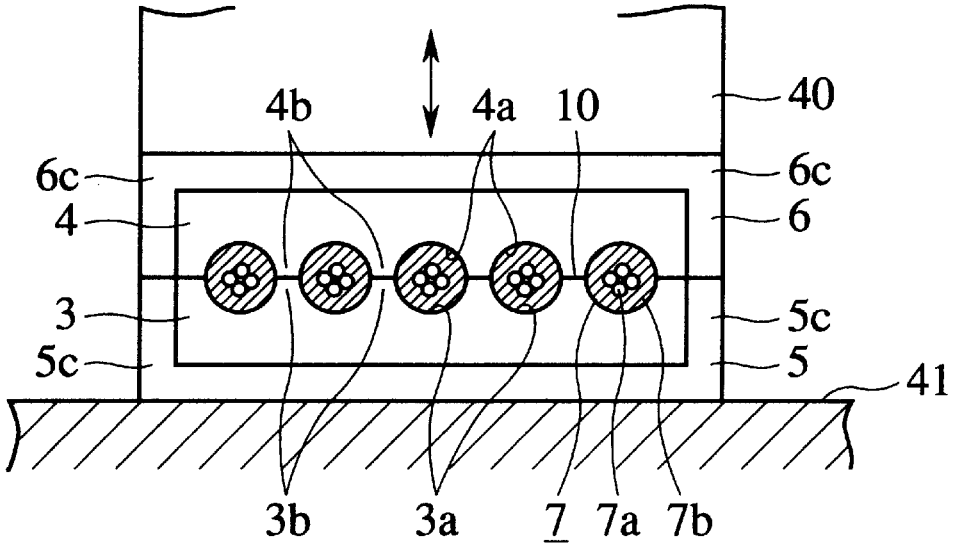
FIG. 4 is a front view including a partial cross section, showing the manufacturing process of the connector of FIG. 1.

Under the above-mentioned condition, as shown in FIG. 4, the butting waterproof members 20, 20 are then mounted on a table 41 and thereafter, the ultrasonic waves are generated on the cover body 6 by an ultrasonic horn 40 while pressing the body 6 downward. Consequently, the butting ribs 5*c*, 6*c* on both side of the cover bodies 5, 6 are fused in each other, so that the bodies 5, 6 are integrated into one body.

At the time of fusing the cover bodies 5, 6 in each other by the ultrasonic oscillation, the inner faces 5*a*, 6*a* of the bodies 5, 6 are deposited with the outer face 8*a* of the leading part 8 in integral with the housing 2 (see FIG. 1), while the corresponding ribs 3*a*, 4*a* of the waterproof members 3, 4 are welded with each other. Simultaneously, in the waterproof members 3, 4, the accommodating grooves 3*a*, 4*a* are partially melted to integrate with the insulating covers 7*b* of the wires 7. The melting of the accommodating grooves 3*a*, 4*a* with the insulating covers 7*b* is represented by a fusion zone 9 in FIG. 1.

In this way, according to the embodiment, the waterproof structure for the wire leading part of the connector 1 is provided by fusing the waterproof members 3, 4 in each other, fusing the members 3, 4 in the insulating covers 7*b* of the covered wires 7, and fusing the cover bodies 5, 6 in the housing 2 at the same time of fusing the separated cover bodies 5, 6 by the ultrasonic oscillation.

Thus, according to the embodiment, since the only ultrasonic oscillating process allows the cover body 5 and the cover body 6, the cover bodies 5, 6 and the housing 2, and the waterproof members 3, 4 and the insulating covers 7 of the wires 7 to be integrated with each other, respectively and simultaneously, it is possible to simplify the manufacturing process of the connector.

Further, owing to the above-mentioned melting and fusing in the waterproof structure, it is possible to construct the housing 2, the cover bodies 5, 6, the waterproof members 3, 4, and the wires 7 as if they were one integrated component, whereby the waterproof performance can be improved with the enhanced sealing capability among the above elements.

According to the embodiment, owing to the fusing of the waterproof member 3 and the waterproof member 4, and the members 3, 4 and the insulating covers 7*b* of the wires 7 at the ultrasonic oscillation, it is possible to provide the waterproof structure as the integrated components exhibiting the above-mentioned high waterproof performance in regard to various kinds or sizes of the wires. Therefore, the waterproof structure of the embodiment is capable of wide application.

In addition, with the above-mentioned simple manufacturing process and the wide application, it is possible to reduce the manufacturing cost.

the second embodiment

Figure 5:
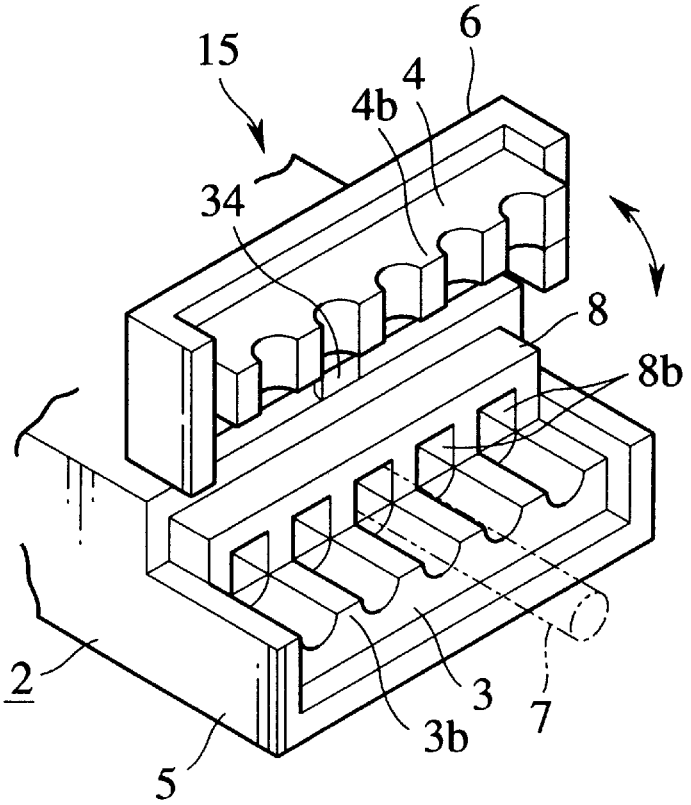
FIG. 5 is a perspective view of a connector housing equipped with a waterproof structure, in accordance with a second embodiment of the invention.

FIG. 5 shows a connector equipped with the waterproof structure of the wire leading part, in accordance with the second embodiment of the invention. The second embodiment only differs from the first embodiment in respect of mount arrangement for the cover bodies 5, 6.

That is, according to the embodiment, the cover body 5 is formed in integral with the housing 2 so as to project from the end face of the housing 2 on the side of the leading part 8. While, the other cover body 6 is linked to an upper edge of the above end face through a hinge 34 integrally.

Such a formation of the cover bodies 5, 6 allows the housing 2 to be molded integrally while the cover body 6 is opened and the waterproof members 3, 4 are assembled in the housing 2.

In the embodiment, after the wires 7 are withdrawn from the leading holes 8*b*, the cover body 6 is rotated in its closing direction about the hinge 34 to butt against the cover body 5. Then, the covered wires 7 are interposed between the upper waterproof member 4 and the lower waterproof member 3 while both of the waterproof members 3, 4 are butting against each other. Under such a condition, by oscillating the ultrasonic waves as similar to the previously mentioned embodiment, it is possible to obtain the similar waterproof structure.

According to the embodiment, the waterproof member 4 is formed so that when assembling in the cover body 6, the ribs 4*b* project from the body 6 outward, while the other waterproof member 3 is formed so that when assembling in the cover body 5, the ribs 3*b* go under the body 5. This arrangement allows the closing rotation of the cover 6 to be guided by the projecting ribs 4*b* smooth and precisely.

Since the cover bodies 5, 6 are constituted as one component of the housing 2 in this embodiment, the number of parts can be reduced thereby to facilitate the management for parts and simplify the manufacturing process.

the third embodiment

Figure 6:
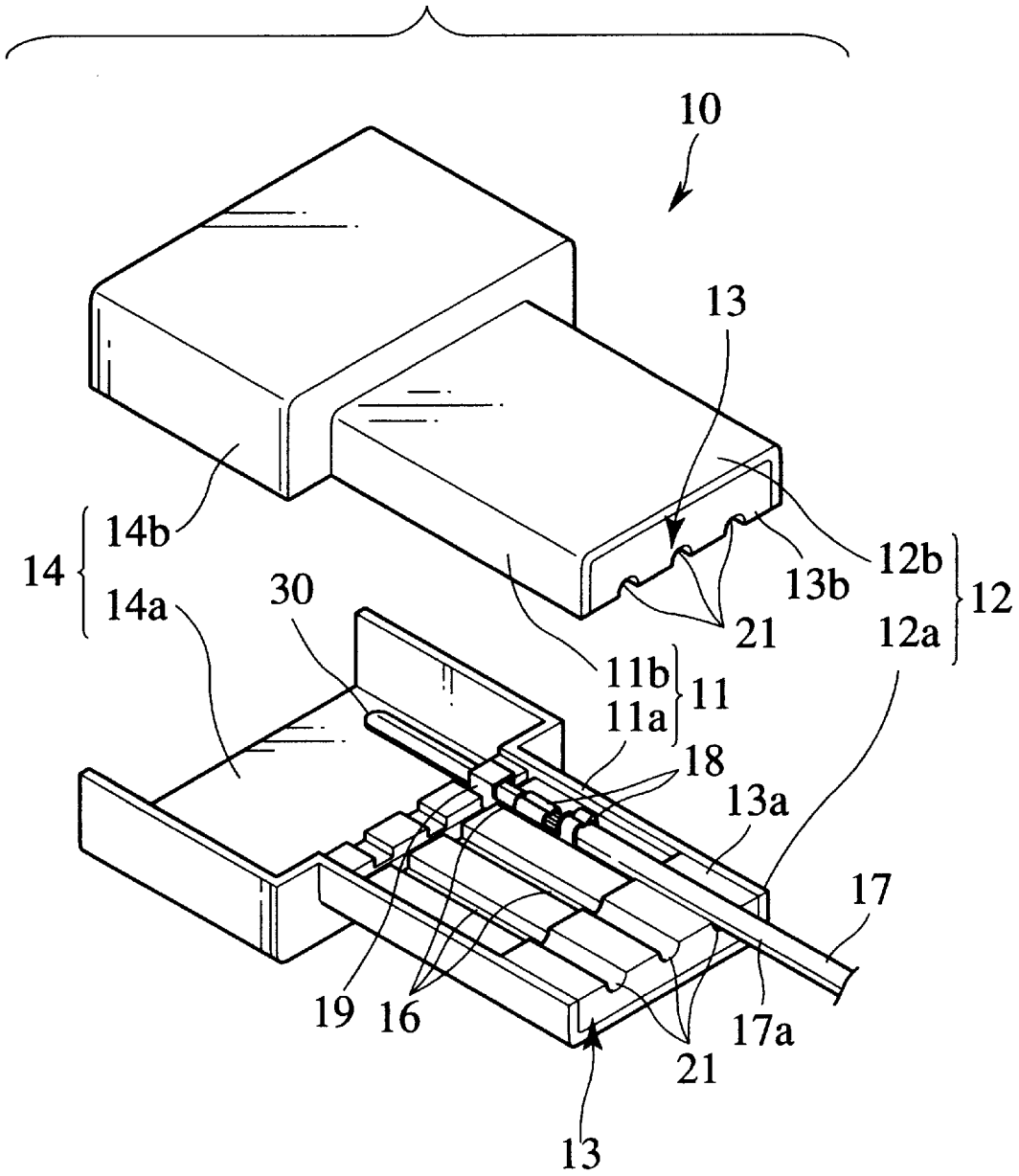
FIG. 6 is an exploded perspective view showing a connector housing equipped with a waterproof structure, in accordance with a third embodiment of the invention.

We now describe the third embodiment of the invention with reference to FIG. 6. According to the embodiment, a housing 11 of a connector 10 is divided into two pieces together with the wire leading part 12, while half waterproof members 13 are arranged on the wire leading part 12 divided into two pieces.

As shown in FIG. 6, the housing 11*a* includes a half hood 14*a* formed on one side thereof and a half wire leading part 12*a* formed on the other side. Being placed upon a half hood 14*b* and a half wire leading part 12*b* of the other housing 11*b*, the half hood 14*a* and the half wire leading part 12*a* constitute a hood 14 and the wire leading part 12, respectively.

The housing 11*a* is provided with three terminal accommodating grooves 16, 16, 16 parallel with each other. Accommodated in each terminal accommodating groove 16 is a male terminal 19 which is connected to a covered wire 17 through crimp pieces 18. Note, each male terminal 19 is arranged so that a contact part 30 thereof projects into the half hood 14*a*. In this way, the covered wires 17 (only one shown in the figure) are drawn out of the housing 11*a* through the wire leading part 12*a*.

The half waterproof member 13*a* constituting the waterproof member 13 is arranged in the half wire leading part 12*a*. When the housings 11*a*, 11*b* are overlaid with each other, the half waterproof member 13*a* is placed on the other half waterproof member 13*b* in the half wire leading part 12*b* of the housing 11*b*, providing the waterproof member 13. Each of the half waterproof members 13*a*, 13*b* is provided with three wire receiving grooves 21 for receiving the wires 17 therein. In this way, under condition that the housings 11*a*, 11*b* are overlaid with each other, the covered wires 17 are interposed between the half waterproof members 13*a* and 13*b*.

It is preferable that respective materials of the housings 11*a*, 11*b* and the half waterproof members 13*a*, 13*b* are similar to those of the cover bodies 5, 6 and the elastic members (waterproof members 3, 4) of the first embodiment, respectively.

In order to obtain the waterproof structure of the wire leading part for the above-mentioned connector 10, the male terminals 19 connected to the wires 17 are firstly accommodated in the terminal accommodating grooves 16 of the housing 11*a* in a manner that their contact parts 20 project into the half hood 14*a*, while the covered wires 17 are inserted into the grooves 21 on the half waterproof member 13*a* and drawn out of the housing 11*a*.

Next, the other housing 11*a* is overlaid on the housing 11*a* for integration. Consequently, since the half wire leading parts 12*a*, 12*b* are overlaid on each other, the wires 17 are interposed between the half waterproof members 13*a* and 13*b*.

Subsequently, with the ultrasonic oscillation for the resulting housing 11, the housing 11*a*, 11*b* are fused while the half waterproof members 13*a*, 13*b* are fused to each other. Simultaneously, the half waterproof members 13*a*, 13*b* are fused in the insulating covers 17*a* of the wires 17, while the housings 11*a*, 11*b* are fused in the half waterproof members 13*a*, 13*b*.

According to the embodiment, since the wire leading part 12 is subjected to the ultrasonic oscillation while the covered wires 17 are interposed between the half waterproof members 13*a* and 13*b*, the insulating covers 17*a* of the wires 17 and the half waterproof members 13*a*, 13*b* are fused for integration. Therefore, no clearance is produced between the wires 17 and the waterproof members 13, thereby accomplishing the high waterproof performance.

Further, owing to the ultrasonic oscillation between the half waterproof members 13*a* and 13*b* and between the members 13*a*, 13*b* and the insulating covers 17*a* of the wires 17, it is possible to provide the waterproof structure as the integrated components exhibiting the above-mentioned high waterproof performance in regard to various kinds or sizes of the wires. Therefore, the waterproof structure of the embodiment is capable of wide application.

Additionally, when comparing the waterproof structure of the embodiment with the conventional waterproof structure using the rubber plug, the former structure is capable of enduring pressure of two and a half times as much as a pressure of compressed air that the rubber plug of the latter structure can endure.

the fourth embodiment

Figure 7:
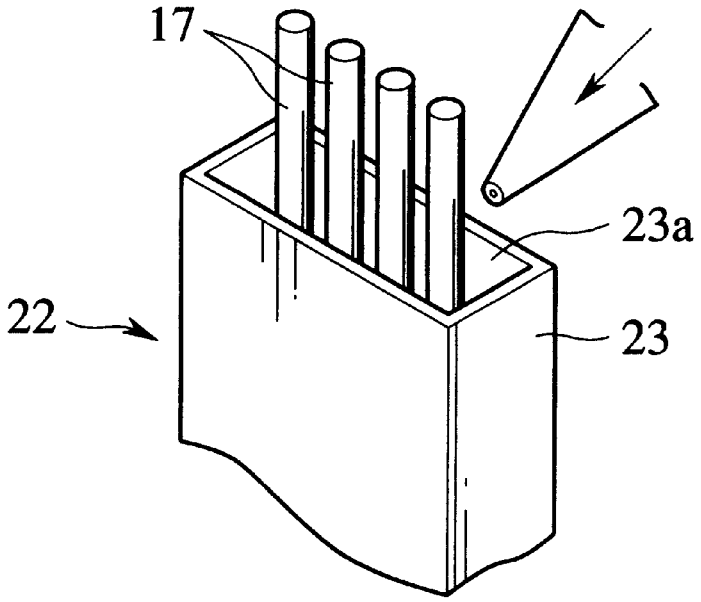
FIG. 7 is a perspective view showing a condition before a waterproof member is charged into a wire leading part, in accordance with a fourth embodiment of the invention.
Figure 8:
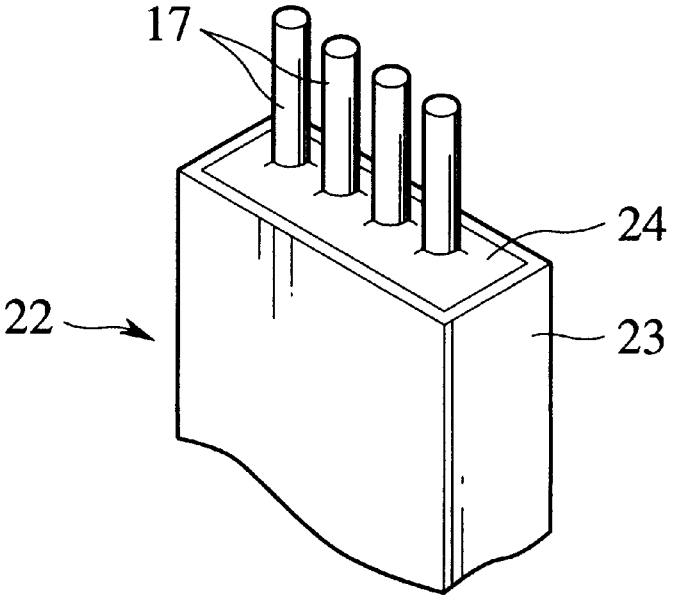
FIG. 8 is a perspective view showing a condition after the waterproof member is charged into the wire leading part of FIG. 7, in accordance with the fourth embodiment of the invention.

Referring to FIGS. 7 and 8, the fourth embodiment will be described as below. As shown in FIG. 7, a wire leading part 23 of this connector 22 is shaped to be a box through which the plural wires 17 are drawn to the outside. Disposed between an inner wall 23*a* of the wire leading part 23 and the covered wires 17 is a waterproof member 24 which has been molten at a temperature more than a melting point of the insulating covers 17*a* of the wires 17 and charged into the wire leading part 23. Therefore, when the molten waterproof member (material) 24 is charged into the wire leading part 23, the insulating covers 17*a* of the wires 17 are fused to integrate with the member 24.

It is preferable that respective materials of the wire leading part 23 and the waterproof member 24 are similar to those of the cover bodies 5, 6 and the elastic members (waterproof members 3, 4) of the first embodiment, respectively.

Also in this embodiment, owing to the charging of the waterproof member 24 which is soluble in the insulating covers 17*a* of the wires 17, it is possible to provide the waterproof structure with high waterproof performance.

the fifth embodiment

We now describe the fifth embodiment shown in FIGS. 9 to 12. According to the embodiment, a connector 25 includes a wire leading part 26 which is molded of soluble material in the insulating covers 17*a* of the wires 17 and which is to be pressed and heated for the waterproof structure while the covered wires 17 are drawn out.

Figure 9:
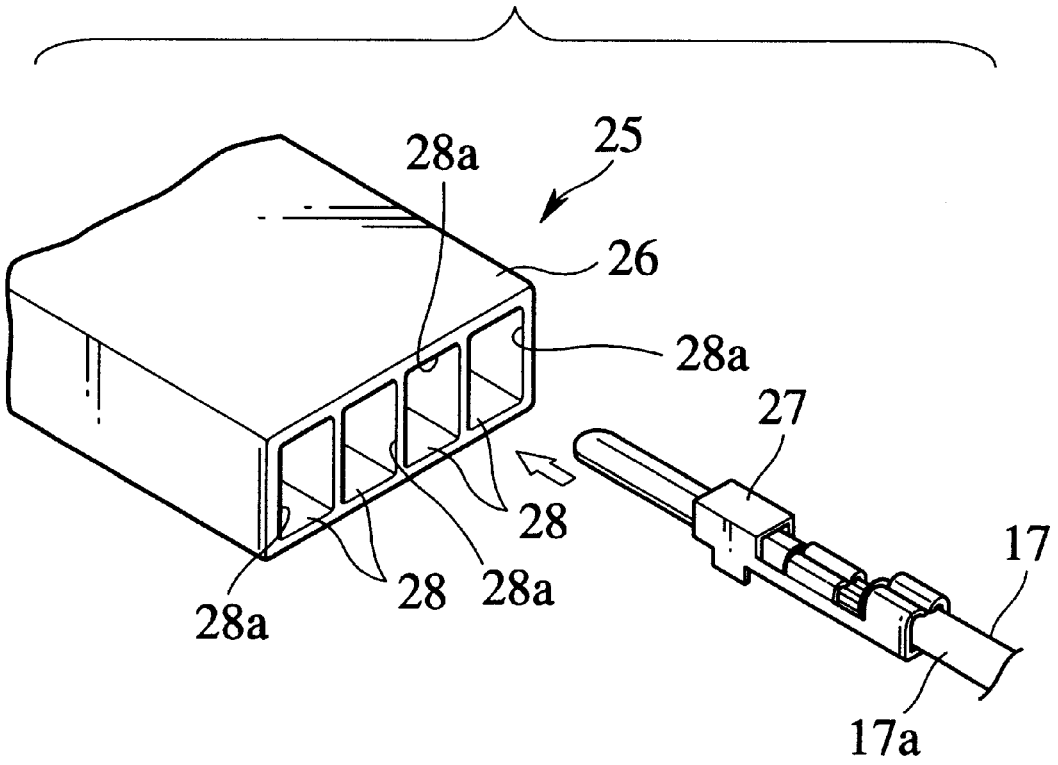
FIG. 9 is a perspective view showing a wire leading part, in accordance with a fifth embodiment of the invention.
Figure 10:
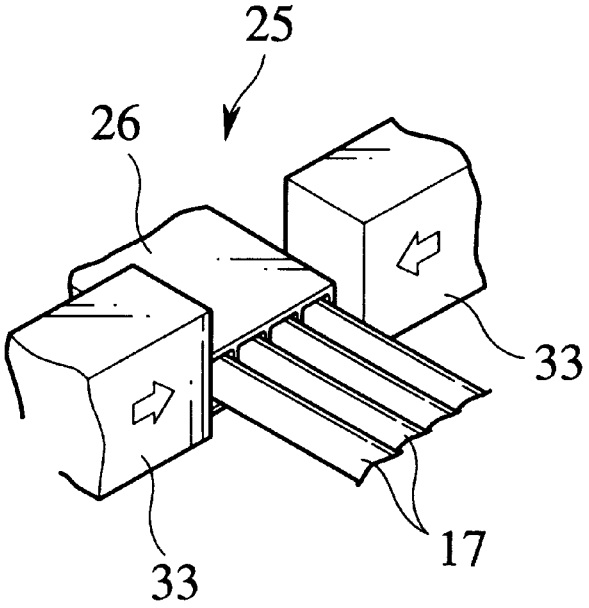
FIG. 10 is a perspective view showing a condition just before the wire leading part of FIG. 9 is pressed.

As shown in FIG. 9, the wire leading part 26 of the embodiment is provided with four parallel terminal accommodating chambers 28 into which male terminals 27 are inserted respectively. Each male terminal 27 is crimped and connected to an end of the wire 17 and inserted into the chamber 28 through an opening 28*a*.

Under condition that the covered wires 17 are drawn through the openings 28*a*, compressive forces are applied on the wire leading part 26 along the width direction by opposing jigs 33, 33. Due to this compression, a clearance between the adjoining wires 17, 17 is narrowed.

Figure 11:
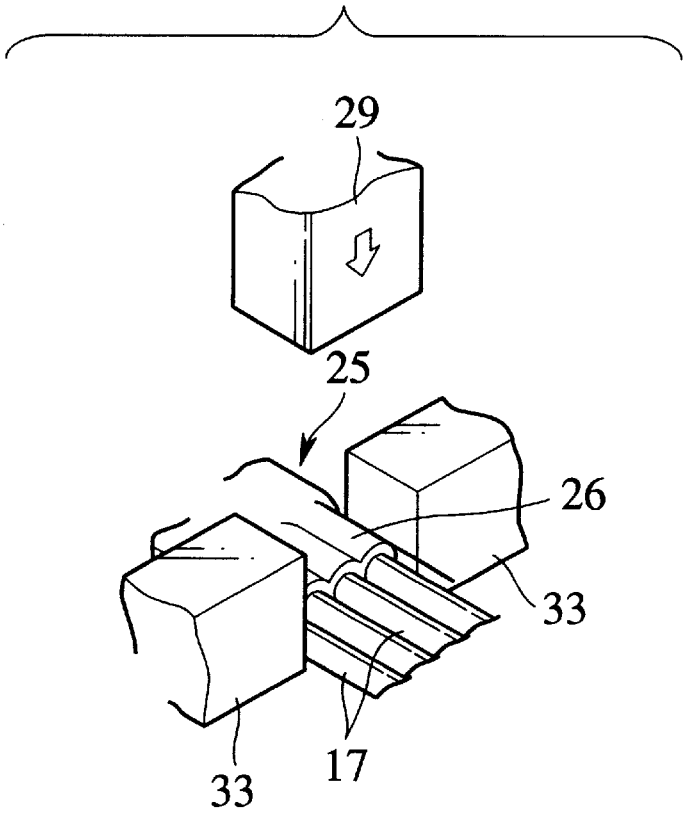
FIG. 11 is a perspective view showing a condition just before the wire leading part of FIG. 9 is heated after being pressed.
Figure 12:
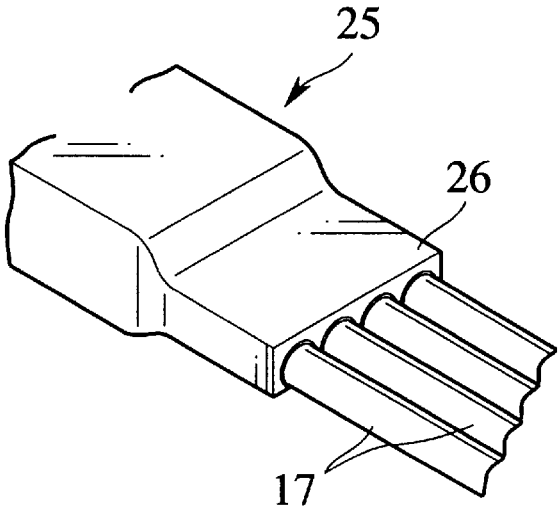
FIG. 12 is a perspective view showing a condition that the wire leading part of FIG. 9 has been pressed and heated.

Next, as shown in FIG. 11, the compressed wire leading part 26 is heated and fused by an electrode 29. Consequently, the wire leading part 26 having the wires 17 supported therein is fused to be a flatten configuration as shown in FIG. 12 and simultaneously, the part 26 and the insulating covers 17*a* of the wires 17 are mutually dissolved for one body.

Under such a condition, since the wires 17 and the wire leading part 26 are molten for integration, no clearance is produced therebetween, whereby the high waterproof performance can be realized.

Of course, material which is mutually soluble in the insulating covers 17*a*, that is, similar one to the half waterproof members 13*a*, 13*b* of the third embodiment is appropriate for material of the wire leading part 26.

Finally, although the above-mentioned waterproof structures of the embodiments are applied to the electrical connectors in common, it will be understood by those skilled in the art that the present invention is applicable to an electrical connection box, all wiring instruments having the wire leading parts or the like without limiting to the shown embodiments.

Note, although the fusing between the waterproof members and the insulating covers of the wire and the mutual fusing between the waterproof members are accomplished by the ultrasonic oscillation, these elements may be heated and welded by the other welding methods.

Further, although the above-mentioned embodiments are directed to the instruments adopting the electrical wires as the covered conductors, the present invention can be applied to other instruments using FPC as the conductors.

What is claimed is:

1. A waterproof structure for a wire leading part of a housing, through which a plurality of electrical wires covered with insulating covers are drawn out of said housing, said waterproof structure comprising:

two waterproof members for interposing said electrical wires therebetween at said wire leading part, said waterproof members being made of elastic materials which are soluble in each other and soluble in said insulating covers by ultrasonic oscillation under pressure; and two cover bodies for supporting said waterproof members respectively, said cover bodies being made of materials which are fusible in each other and soluble in said housing by ultrasonic oscillation under pressure;

wherein said waterproof members are fused in each other and fused in said insulating covers at the same time of mutually fusing of said cover bodies by the ultrasonic oscillation, while said cover bodies are fused in said housing into one body.

2. A method of producing a waterproof structure for a wire leading part of a housing, said method comprising the steps of:

partially drawing at least one electrical wire, which is covered with an insulating cover, out of said housing through said wire leading part;

interposing said electrical wire between two waterproof members at said wire leading part in a manner that said waterproof members butt against each other, said waterproof members being respectively carried by cover bodies; and oscillating said waterproof members by ultrasonic waves through said cover bodies, thereby fusing said waterproof members in each other, fusing said waterproof members in said insulating cover, and fusing said cover bodies in said housing, integrally.

* * * * *